US005251779A

United States Patent [19]

Schmidt

[11] Patent Number: 5,251,779

[45] Date of Patent: Oct. 12, 1993

[54] TRASH CONTAINER

[76] Inventor: Stefan Schmidt, Am Zollstock II, D-3565 Breidenbach-Achenbach, Fed. Rep. of Germany

[21] Appl. No.: 657,339

[22] Filed: Feb. 15, 1991

Related U.S. Application Data

[63] Continuation of Ser. No. 470,989, Jan. 25, 1990, abandoned.

[30] Foreign Application Priority Data

Jan. 25, 1989 [DE] Fed. Rep. of Germany ..... 8900783

[51] Int. Cl.[5] ..... B65F 3/08

[52] U.S. Cl. ..... 220/656; 220/751; 220/908; 220/659

[58] Field of Search ..... 220/908, 482, 94 A, 220/656, 659, 751; 414/406, 408, 409

[56] References Cited

U.S. PATENT DOCUMENTS

| | | | |
|---|---|---|---|
| 3,005,572 | 10/1961 | Gustafson et al. | 220/659 |
| 3,140,788 | 7/1964 | Clar | 414/408 |
| 3,874,534 | 4/1975 | Brisson | 414/406 |
| 4,613,271 | 9/1986 | Naab | 414/408 |
| 4,648,522 | 3/1987 | Wise | 220/1 T |
| 4,687,405 | 8/1987 | Olney | 414/408 |
| 4,712,701 | 12/1987 | Durkan | 220/1 T |
| 4,715,767 | 12/1987 | Edelhoff et al. | 414/408 |
| 4,726,726 | 2/1988 | Dossena et al. | 414/408 |
| 4,765,503 | 8/1988 | Otto et al. | 220/1 T |
| 4,889,462 | 12/1989 | Naab et al. | 414/408 |
| 4,917,257 | 4/1990 | Edelhoff | 220/1 T |
| 4,943,201 | 7/1990 | Billon | 414/408 |

FOREIGN PATENT DOCUMENTS

| | | | |
|---|---|---|---|
| 138780 | 4/1985 | European Pat. Off. | 220/1 T |
| 0230663 | 8/1987 | European Pat. Off. | 414/408 |
| 288066 | 10/1988 | European Pat. Off. | 220/1 T |
| 327948 | 8/1989 | European Pat. Off. | 414/408 |
| 0354256 | 2/1990 | European Pat. Off. | 414/408 |
| 3420058 | 12/1985 | Fed. Rep. of Germany | 414/408 |
| 3536139 | 4/1987 | Fed. Rep. of Germany | 220/908 |
| 3614328 | 10/1987 | Fed. Rep. of Germany | 414/406 |
| 2584051 | 1/1987 | France | 220/908 |
| 1136893 | 12/1968 | United Kingdom | 220/1 T |

*Primary Examiner*—Allan N. Shoap
*Assistant Examiner*—S. Castellano
*Attorney, Agent, or Firm*—Herbert L. Lerner; Laurence A. Greenberg

[57] ABSTRACT

A trash container includes a body having a substantially rectangular cross section, a wall and a rim with opposite sides. A hinged lid is supported on one of the opposite sides of the rim. The other of the opposite sides of the rim has a receiving channel with an open bottom and an outer wall formed therein. A guide device is disposed on the receiving channel for engagement by a gripper of a hoisting and dumping apparatus. The guide device is formed of a guide tongue being integral with the outer wall of the receiving channel and pointing downward away from the wall of the body.

16 Claims, 3 Drawing Sheets

TRASH CONTAINER

This application is a continuation of application Ser. No. 470,989, filed Jan. 25, 1990, now abandoned.

The invention relates to a trash container with a substantially rectangular cross section, including a hinged lid supported on the rim of the container, a receiving or pickup channel with an open bottom being formed onto the side of the rim of the container opposite the support of the hinged lid, and a guide device located on the channel for engagement by a gripper of a hoisting and dumping apparatus.

Trash containers or garbage cans of the above-mentioned kind, which are made of injection molded plastic, have long been available in commerce and are therefore well known. When trash is picked up with trucks that have a hoisting and dumping apparatus for emptying the containers, the trash containers are manually brought to the hoisting and dumping apparatus of the garbage truck in such a way that a gripper engages a receiving or pickup channel with an open bottom on the rim of the container, at the beginning of the hoisting and dumping motion.

The outer rim of the receiving or pickup channel is stabilized on the container wall by reinforcing ribs, which extend transversely from the container wall through the receiving or pickup channel. The gripper and the hoisting and dumping apparatus have recesses in the vicinity of the reinforcing ribs, so that the reinforcing ribs of the container will not rest on the gripper. The trash container must always be positioned exactly, in such a way that the claws of the gripper will engage a point between the reinforcing ribs, and the correctly tilted container will arrive at the hopper opening of the garbage truck. Given the haste with which trash is generally picked up, this requires great skill and attentiveness on the part of the workers assigned to the garbage truck.

Various equipment has already been devised for facilitating accurate positioning of the trash containers with respect to the hoisting and dumping apparatus of the garbage truck. Published European Application No. 0 185 382 discloses a trash container of the type described above on which the lid seat or support can be secured opposite a support plate, which is supported with its upper rim on the pickup rim of the trash container and is constructed as an adaptor, with a receiving or pickup pocket approximately in the form of a section of a conical surface. The hoisting and dumping apparatus on the garbage truck has a gripper that tapers upward like a wedge and is inserted into the pocket on the container at the beginning of the hoisting operation, so as to align the pocket laterally in the process. Such a specialized hoisting and dumping apparatus is unable to grasp trash containers of the widely used type as described above. The adaptor part, which must be removably attached to the trash container, is very complicated both in structure and in manufacture and so far has never gained widespread acceptance.

German Utility Model or Petty Patent DE-GM 85 19 096 discloses a simpler version with a similar adaptor part. In that case, receiving or pickup means with an open bottom are integrally formed onto the side of the container opposite the lid seat or support, for coupling engagement by gripper claws of a hoisting and dumping apparatus; the receiving or pickup means are formed of an approximately triangular receiving or pickup pocket with an upwardly-pointing rounded tip in the middle; the front wall of the pocket facing the trash container is substantially flat, and its rear wall extends outwardly either obliquely in a wedge, or in a rounded spherical seat or support.

German Patent DE-PS 37 03 034 provides an improvement of such a receiving or pickup pocket for engagement by a gripper, in such a way that the pocket is formed of at least two approximately parallel wall portions that are joined together by buttresses.

Bulky adaptor parts of that kind, which are integrally joined to the trash container, make the trash containers considerably more expensive than the types that are widely used. For one thing, very complicated and therefore expensive injection molding dies are needed for the integral formation of such receiving or pickup means, and the cost of such guides considerably increases the price of the trash containers. For another, the consumption of material is also very much greater, because of the bulky pocket structures.

It is accordingly an object of the invention to provide a trash container, which overcomes the hereinaforementioned disadvantages of the heretofore-known devices of this general type. Furthermore, the adaptor part should be more simply constructed, and the molding thereof to the container rim should involve less expense for molding equipment and should use less material. Moreover, the container of the invention should be constructed in such a way that a hoisting and dumping apparatus constructed for emptying the trash container according to the invention should also be capable of emptying conventional types of trash containers.

With the foregoing and other objects in view there is provided, in accordance with the invention, a trash container, comprising a body having a substantially rectangular cross section, a wall and a rim with opposite sides, a hinged lid supported on one of the opposite sides of the rim, the other of the opposite sides of the rim having a receiving channel with an open bottom and an outer wall formed therein, and a guide device disposed on the receiving channel for engagement by a gripper of a hoisting and dumping apparatus, the guide device being formed of a guide tongue being integral with the outer wall of the receiving channel and pointing downward away from the wall of the body.

In accordance with another feature of the invention, the guide tongue has an approximately triangular basic surface tapering from a base to a point at a bottom tip, and a reinforcement profile extending from the base to the tip.

In accordance with a further feature of the invention, the guide tongue is a channel with a smooth, round bottom and an axis of symmetry extending from the middle of the base to the tip.

In accordance with an added feature of the invention, the guide tongue has a base in the form of a vertical wall section being formed into the outer wall of the receiving channel and having the shape of an inwardly curved sector of a cylindrical surface.

In accordance with an additional feature of the invention, the guide tongue has a channel-like basic shape with a base, a tip, and corrugations extending from the tip to the base and forming fan-like rays.

In accordance with yet another feature of the invention, the guide tongue has a substantially triangular basic surface, a base, a tip, and the shape of a V-shaped channel with an axis of symmetry extending from the middle of the base to the tip.

In accordance with yet a further feature of the invention, the guide tongue has a channel-like basic shape with a base, a tip, and V-shaped furrows extending in ray-like fashion from the tip to the base.

In accordance with yet an added feature of the invention, the tongue has the shape of a sector of a conical surface.

In accordance with yet an additional feature of the invention, the vertical wall section forming the base of the guide tongue has a vertical corrugation.

In accordance with again another feature of the invention, the receiving channel has an inner surface and reinforcing ribs on the inner surface.

In accordance with again a further feature of the invention, the body has a front, and the outer wall of the receiving channel has an inner surface and guide strips on the inner surface at the front of the body.

In accordance with a concomitant feature of the invention, there are provided reinforcing ribs reinforcing the guide tongue.

Other features which are considered as characteristic for the invention are set forth in the appended claims.

Although the invention is illustrated and described herein as embodied in a trash container, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 1:
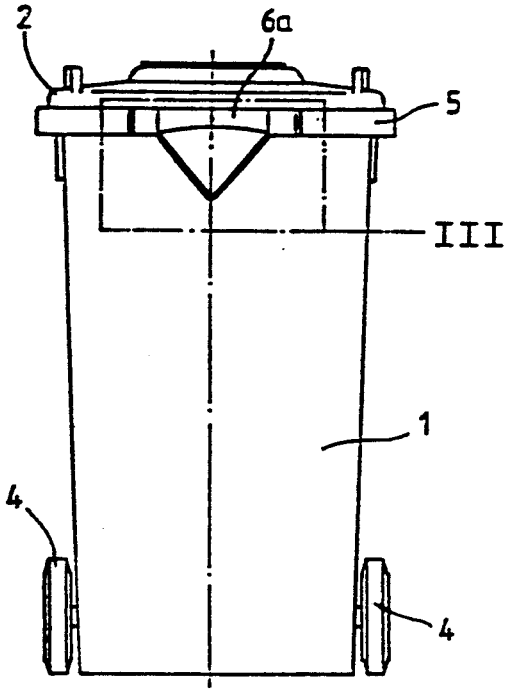
FIG. 1 is a fragmentary, diagrammatic, front-elevational view of a trash container according to the invention.
Figure 2:
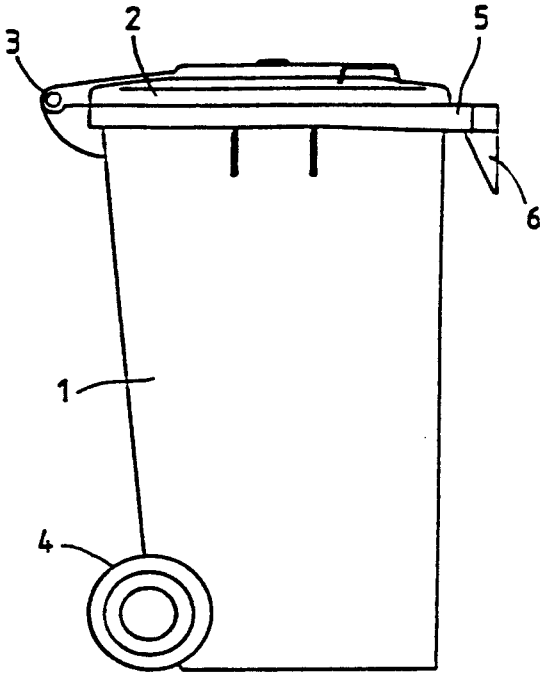
FIG. 2 is a side-elevational view of the container of FIG. 1.
Figure 3:
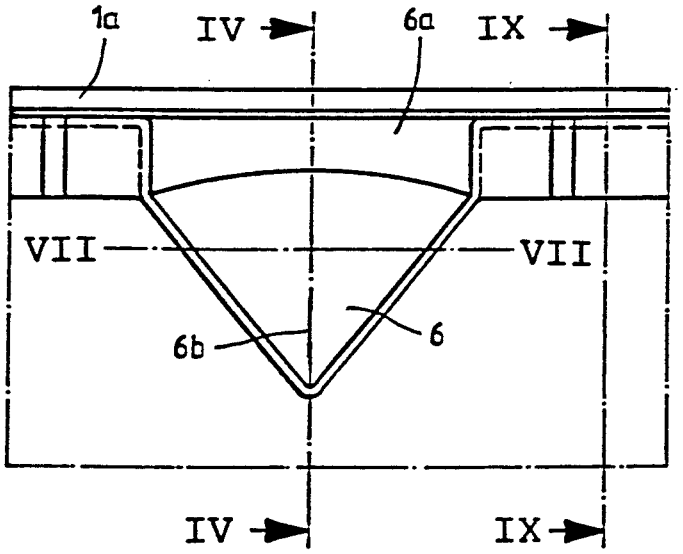
FIG. 3 is an enlarged view of the portion III of FIG. 1, without a lid.

Referring now to the figures of the drawing in detail and first, particularly, to FIG. 1 thereof, there is seen a trash container which is substantially formed of a body or body part 1 with a rectangular cross section and a hinged lid 2. Each of the two pieces is constructed as a one-piece plastic injection molded part. Through the use of a lid shaft 3 shown in FIG. 2, the hinged lid 2 is seated on the rim of a narrow side of the body 1, hereinafter called the rear, in such a way that it can be folded down onto the container opening. The exemplary embodiment shown in this case relates to a trash container intended particularly for household use, which is equipped with a pair of wheels 4 disposed at the bottom and supported at the back in a known manner, for better mobility.

Figure 4:
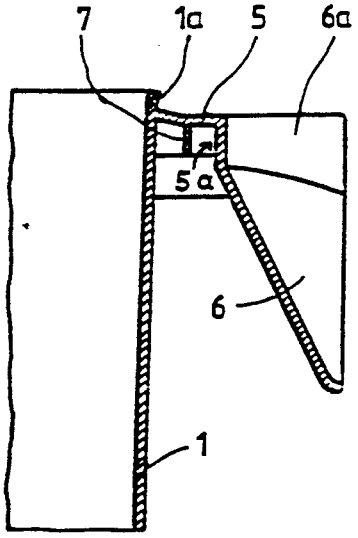
FIG. 4 is a longitudinal-sectional view taken along the line IV—IV of FIG. 3, in the direction of the arrows.
Figure 5:
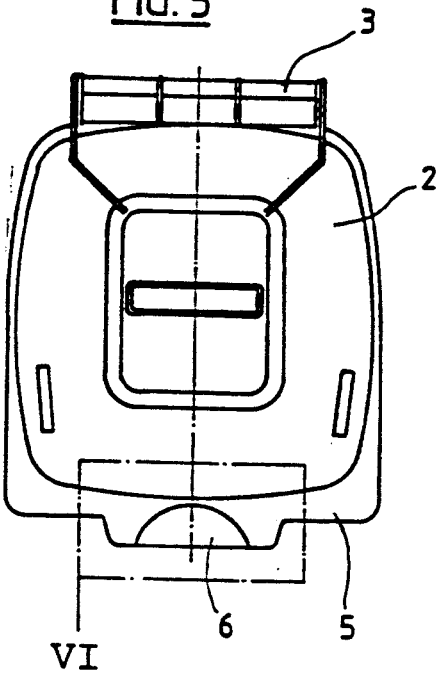
FIG. 5 is a top-plan view of the trash container of FIG. 1.
Figure 6:
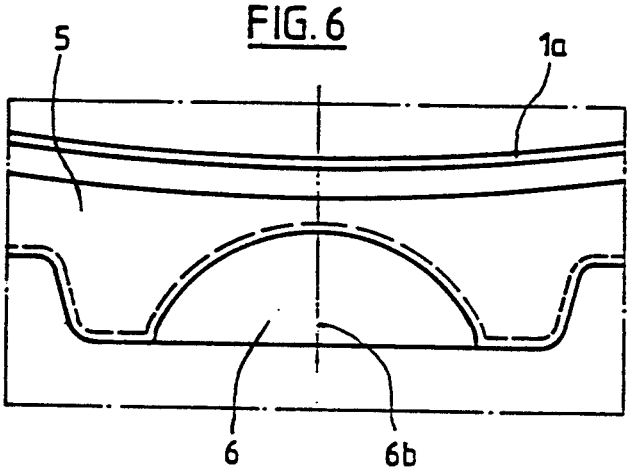
FIG. 6 is an enlarged view of the portion VI of FIG. 5, without a lid.

The front of the body 1 has a receiving or pickup channel 5 under the rim 1*a* at the opening, as seen in FIG. 4. The receiving or pickup channel 5 is open at the bottom and formed onto the outer wall of the container, for receiving the gripper of a hoisting and dumping apparatus. A guide tongue 6 pointing downwardly and away from the container wall is molded onto the outer wall of the receiving or pickup channel 5. The guide tongue has an approximately triangular basic surface tapering to a point at the bottom, and a reinforcement with a profile tapering to a point at a base 6*a*. In the exemplary embodiment shown in FIGS. 1–7, the guide tongue 6 is constructed as a channel with a smooth, round bottom, the axis of symmetry 6*b* of which extends from the middle of the base to the tip of the tongue.

The base 6*a* of the guide tongue 6 is constructed as a vertical wall section, which is formed into the outer wall of the receiving or pickup channel 5, in the form of an inwardly curved sector of a cylindrical surface.

Shaping the guide tongue 6 and its base 6*a* in the manner described above makes it possible to place a considerable load on the guide tongue in any direction; in this way it can handle the rough operation typical of a trash pickup operation and it can fulfill its purpose.

Figure 7:
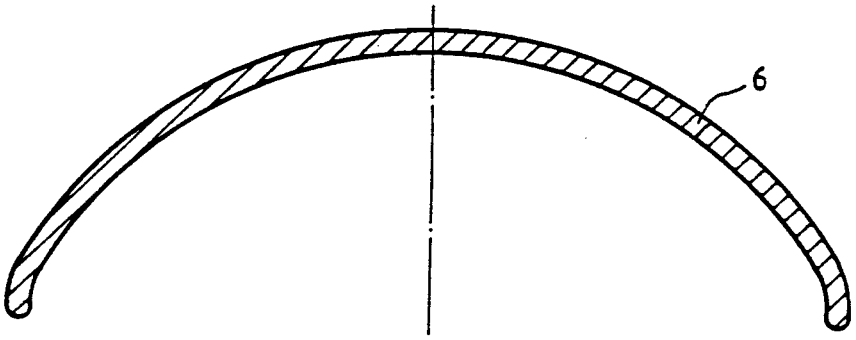
FIG. 7 is a further enlarged cross-sectional taken along the line VII—VII of FIG. 3.
Figure 8:
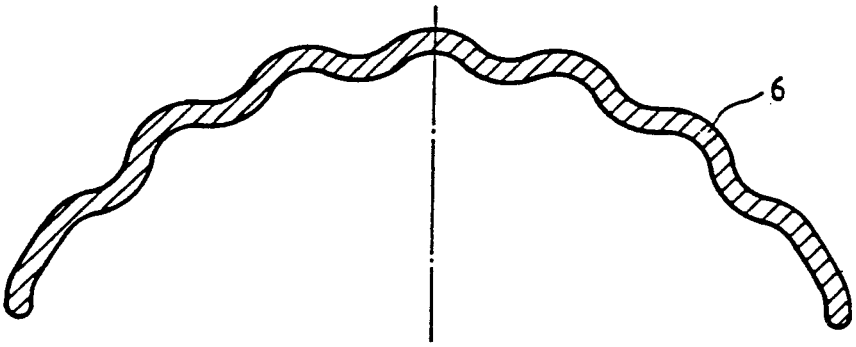
FIG. 8 is a further enlarged cross-sectional view a different embodiment taken along the line VII—VII of FIG. 3.

FIG. 8 shows an embodiment of the reinforcement profile of the guide tongue 6 which differs from that shown in FIG. 7. The guide tongue 6 of FIG. 8 is again substantially channel-like in form. However, the channel bottom is also corrugated, in such a way that the corrugations form fanlike rays from the tongue tip, to the base 6*a*.

Figure 9:
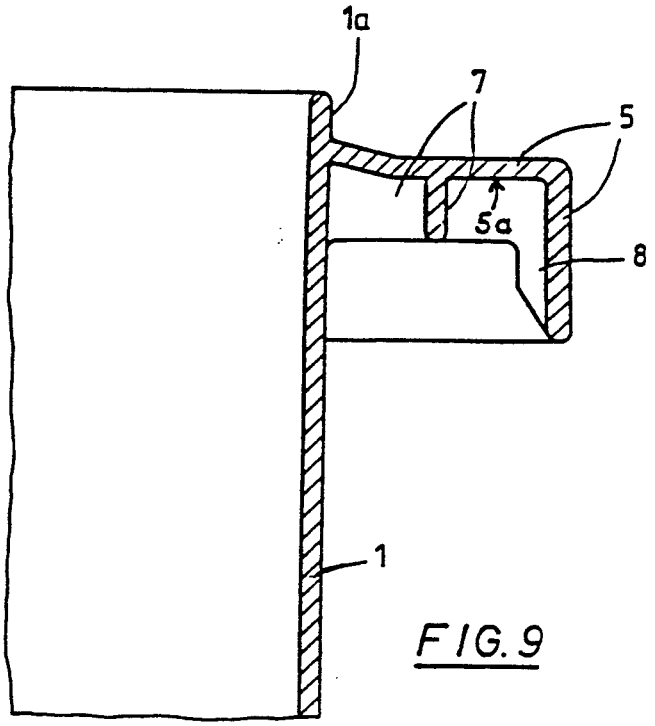
FIG. 9 is a longitudinal-sectional view taken along the line IX—IX of FIG. 3, in the direction of the arrows.

As seen in FIG. 9, the receiving or pickup channel 5 is equipped with reinforcing ribs 7 on the inner surface 5*a* thereof. The ribs simultaneously form a bearing surface for the gripper of the hoisting and dumping apparatus. Guide ribs 8 provided on the inside of the outer wall of the receiving or pickup channel 5 on the front of the container serve as additional guide elements for the gripper.

Still other versions of the reinforcement profile in accordance with the invention are also possible. For example, the guide tongue 6 may have a substantially triangular basic surface and be constructed with a V or substantially channel-like shape, with an angular channel bottom, and with the edges extending in ray-like fashion from the tip of the tongue to the base 6*a*.

Figure 10:
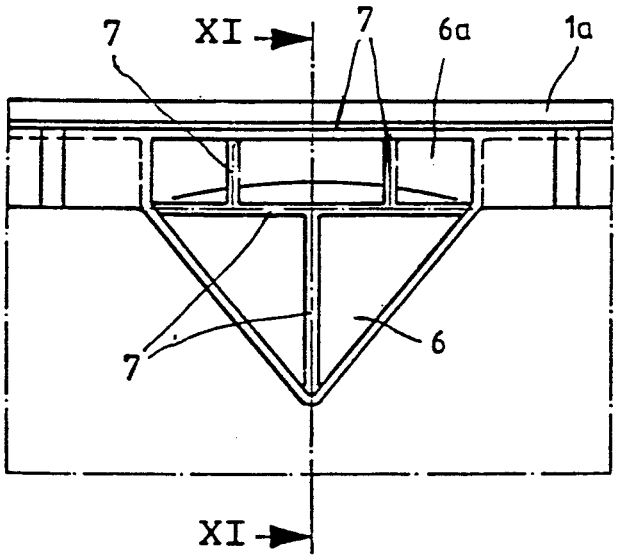
FIG. 10 is an enlarged view of the portion III of FIG. 1 with guide tongues having reinforcing ribs.
Figure 11:
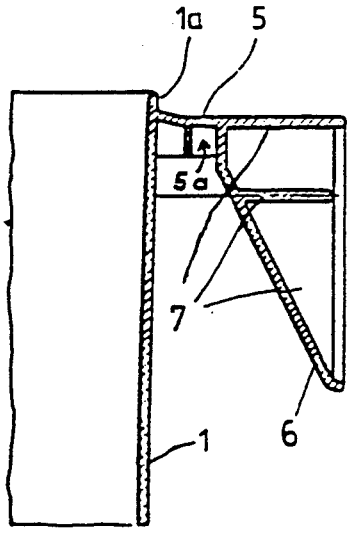
FIG. 11 is a longitudinal-section view taken along the line VI—VI of FIG. 10, in the direction of the arrows.

In the structure shown in FIGS. 10 and 11, the guide tongue 6 is additionally reinforced with reinforcing ribs 7 disposed on the outside.

The foregoing is a description corresponding in substance to German Application G 89 00 783.2, dated Jan. 25, 1989, the International priority of which is being claimed for the instant application, and which is hereby made part of this application. Any material discrepancies between the foregoing specification and the aforementioned corresponding German application are to be resolved in favor of the latter.

I claim:

1. Trash container, comprising a body having a substantially rectangular cross section, a wall and a rim with opposite sides, a hinged lid supported on one of said opposite sides of said rim, the other of said opposite sides of said rim being formed as a receiving channel member having an open bottom and an outer wall, means for reinforcing said channel member so that the trash container is liftable thereby, and a guide device disposed on said outer wall of said receiving channel member for guiding a gripper of a hoisting and dumping apparatus into said receiving channel member, said guide device being formed of a guide tongue integral with said outer wall of said receiving channel and pointing downwardly away from said outer wall and away from said wall of said body.

2. Trash container according to claim 1, wherein said guide tongue has an approximately triangular basic surface tapering from a base to a point at a bottom tip, and a reinforcement with a profile extending from said base to said tip.

3. Trash container according to claim 2, wherein said guide tongue is a channel with a smooth, round bottom and an axis of symmetry extending from the middle of said base to said tip.

4. Trash container, comprising a body having a substantially rectangular cross section, a wall and a rim with opposite sides, a hinged lid supported on one of said opposite sides of said rim, the other of said opposite sides of said rim having a receiving channel with an open bottom and an outer wall formed therein, and a guide device disposed on said receiving channel for engagement by a gripper of a hoisting and dumping apparatus, said guide device being formed of a guide tongue being integral with said outer wall of said receiving channel and pointing downward from said wall of said body, said guide tongue having a base in the form of a vertical wall section being formed into said outer wall of said receiving channel and having the shape of a convexly curved sector of a cylindrical surface as seen from said body.

5. Trash container according to claim 1, wherein said guide tongue has a channel shape with a base, a tip, and corrugations extending from said tip to said base and forming fan rays.

6. Trash container according to claim 1, wherein said guide tongue has a substantially triangular basic surface, a base, a tip, and the shape of a V-shaped channel with an axis of symmetry extending from the middle of said base to said tip.

7. Trash container according to claim 1, wherein said guide tongue has a channel shape with a base, a tip, and V-shaped furrows extending in rays from said tip to said base.

8. Trash container according to claim 1, wherein said guide tongue has the shape of a sector of a conical surface.

9. Trash container according to claim 4, wherein said vertical wall section forming said base of said guide tongue has a vertical corrugation.

10. Trash container according to claim 1, wherein said receiving channel member has an interior surface, and said reinforcing means comprise reinforcing ribs on said interior surface.

11. Trash container according to claim 1, wherein said body has a front, and said outer wall of said receiving channel member has an inner surface and guide strips on said inner surface at said front of said body.

12. Trash container according to claim 1, including reinforcing ribs reinforcing said guide tongue.

13. An improved trash container having a body with a substantially rectangular cross section, a wall and a rim with opposite sides, a hinged lid supported on one of the opposite sides of the rim, the other of said opposite sides of the rim being formed as a receiving channel member having an open bottom and an outer wall, so that the trash container is liftable by inserting a gripper of a hoisting and dumping apparatus into the channel member, wherein the improvement comprises: a guide device disposed on the outer wall of the channel member for guiding the gripper of the hoisting and dumping apparatus into the channel member, said guide device being formed of a guide tongue integral with the outer wall of the channel member and pointing downwardly from the outer wall and away from the wall of the trash container body.

14. A trash container according to claim 13, including means for reinforcing the channel member.

15. A trash container according to claim 14, wherein said means comprise reinforcing ribs on an interior surface of the outer wall.

16. A trash container according to claim 13, wherein said guide tongue is substantially triangular and pointing downwardly as seen from the front and substantially flat as seen from the side.

* * * * *